US005901845A

United States Patent [19]

Cheng

[11] Patent Number: 5,901,845

[45] Date of Patent: May 11, 1999

[54] GOLF BAG

[76] Inventor: Der-Ping Cheng, 304 Tushin Rd., Taichung City, Taiwan

[21] Appl. No.: 09/047,468

[22] Filed: Mar. 25, 1998

[51] Int. Cl.[6] ..... A63B 55/00

[52] U.S. Cl. ..... 206/315.7; 248/96

[58] Field of Search ..... 206/315.3, 315.7; 248/96

[56] References Cited

U.S. PATENT DOCUMENTS

| | | | |
|---|---|---|---|
| 1,757,471 | 5/1930 | Platt | 206/315.7 X |
| 5,540,431 | 7/1996 | Crozier | 206/315.3 X |
| 5,799,786 | 9/1998 | Beck et al. | 206/315.7 |
| 5,829,719 | 11/1998 | Han | 248/96 X |

*Primary Examiner*—Gary E. Elkins
*Assistant Examiner*—Tri M. Mai

[57] ABSTRACT

A golf bag includes a bag body for holding golf clubs, the bag body having a top cuff and a bottom cuff at top and bottom sides thereof, and a foldaway stand pivoted to the top cuff of the bag body, the foldaway stand having two pivoted legs for supporting the bag body on the ground in a tilted position, a bottom plate, the bottom plate having a fixed end pivoted to said bottom cuff of said bag body at a bottom side and a free end, and a substantially V-shaped spring wire rod coupled between the free end of the bottom plate and top ends of the legs, wherein a support plate is mounted inside the bottom cuff for supporting golf clubs in one of a plurality of storage chambers in the bag body, the support plate having a fixed end pivoted to an inside wall of the bottom cuff remote from the fixed end of the bottom plate and a free end; two links coupled between the bottom plate and the support plate, for permitting the support plate to be turned upwards/downwards with the bottom plate.

8 Claims, 3 Drawing Sheets

GOLF BAG

BACKGROUND OF THE INVENTION

The present invention relates to a golf bag, and more particularly to such a golf bag which has means to support the bag body stably on the ground in a tilted position.

A golf bag generally has a plurality of storage chambers for holding different types, lengths or numbers of golf clubs. There is known a golf bag that can be supported on the ground in a tilted position. This structure of golf bag comprises a bag body defining a plurality of storage chambers for holding different golf clubs, the bag body having a top cuff and a bottom cuff at top and bottom sides thereof, and a foldaway stand pivoted to the top cuff of the bag body, the foldaway stand having two pivoted legs for supporting the bag body on the ground in a tilted position, a bottom plate, the bottom plate having a fixed end pivoted to said bottom cuff of said bag body at a bottom side and a free end, and a substantially V-shaped spring wire rod coupled between the free end of the bottom plate and top ends of the legs. The spring wire rod forces the pivoted legs and the bottom plate outwards when the bag body is placed on the ground and tilted. In order not to hinder the movement of the user, the size of the bottom plate is limited. Because the bottom plate has a limited size, it cannot firmly support the bag body on the ground in a tilted position. Further, because the storage chambers in the bag body have an equal depth, when short golf clubs are stored in one storage chamber, they are completely received inside the bag body, and the user cannot quickly identify the golf clubs from one another.

SUMMARY OF THE INVENTION

The present invention has been accomplished to provide a golf bag which eliminates the aforesaid drawbacks. It is one object of the present invention to provide a golf bag which can be firmly supported on the ground in a titled position. It is another object of the present invention to provide a golf bag which enables the user to quickly find out the desired nurmber of golf club from the storage golf clubs. It is still another object of the present invention to provide a golf bag which automatically pushes golf clubs out of the top cuff of the bag body thereof when the golf bag is supported on the ground in a tilted position. To achieve these and other objects of the present invention, there is provided a golf bag which comprises a bag body for holding golf clubs, the bag body having a top cuff and a bottom cuff at top and bottom sides thereof, and a foldaway stand pivoted to the top cuff of the bag body, the foldaway stand having two pivoted legs for supporting the bag body on the ground in a tilted position, a bottom plate, the bottom plate having a fixed end pivoted to said bottom cuff of said bag body at a bottom side and a free end, and a substantially V-shaped spring wire rod coupled between the free end of the bottom plate and top ends of the legs, wherein a support plate is mounted inside the bottom cuff for supporting golf clubs in one of a plurality of storage chambers in the bag body, the support plate having a fixed end pivoted to an inside wall of the bottom cuff remote from the fixed end of the bottom plate and a free end; two links coupled between the bottom plate and the support plate, for permitting the support plate to be turned upwards/downwards with the bottom plate.

DETAILED DESCRIPTION OF THE PREFERRED EMBODIMENT

Figure 1:
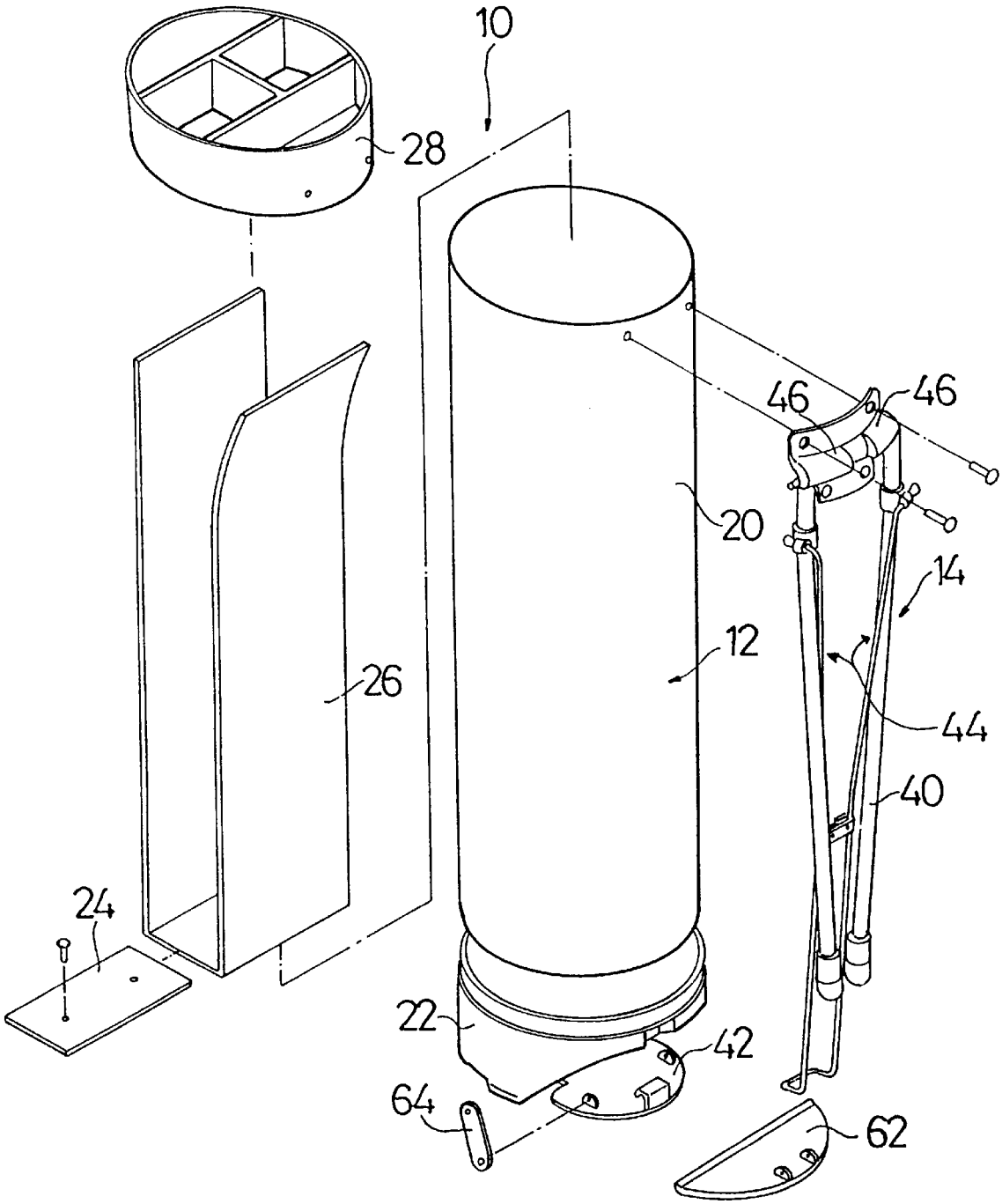
FIG. 1 is an exploded view of a golf bag according to the present invention.
Figure 3:
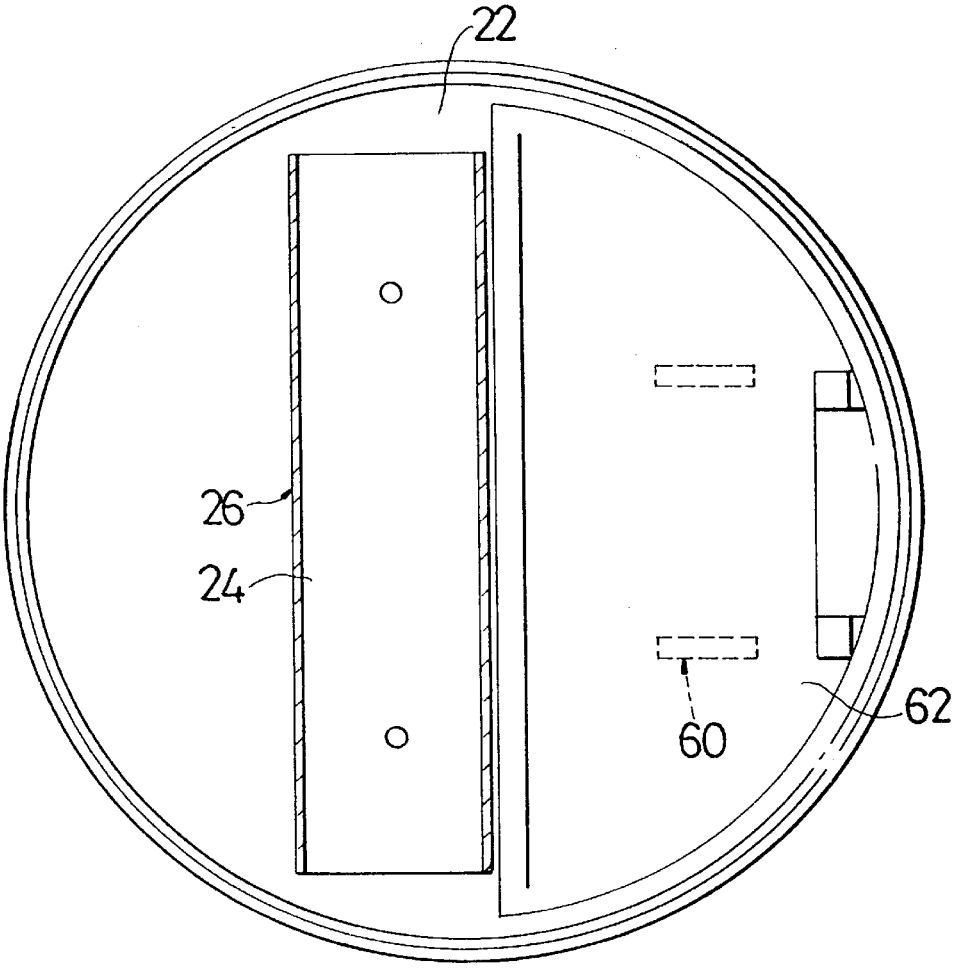
FIG. 3 is a top plain view in an enlarged scale of the golf bag shown in FIG. 1.

Referring to FIGS. from 1 to 3, a golf bag 10 is shown comprised of a cylindrical bag 12, and a foldaway stand 14.

The bag 12 comprises a cylindrical bag body 20, a bottom cuff 22 and a top cuff 28 respectively fastened to top and bottom sides of the bag body 20, a flexible, substantially U-shaped partition member 26 suspended from the top cuff 28 inside the bag body 20, the U-shaped partition member 26 having two opposite ends respectively connected to the top cuff 28 and a middle portion connected to the bottom cuff 22 by a mounting plate 24. The partition member 26 divides the holding space of the bag 12 into three storage chambers.

The foldaway stand 14 comprises two legs 40 respectively pivoted to the top cuff 28, a bottom plate 42 pivoted to the bottom cuff 22 at the bottom, and a substantially V-shaped spring wire rod 44 coupled between the end of the bottom plate 42 and the top ends of the legs 40. When the golf bag 10 is tilted in one direction to force the bottom plate 42 against the ground, the spring wire rod 44 is forced to push the legs 40 outwards, enabling the legs 40 to be stopped at an extended condition by constraint lugs 46, and therefore the bag 12 is supported on the ground by the foldaway stand 14 in a tilted position.

Figure 2:
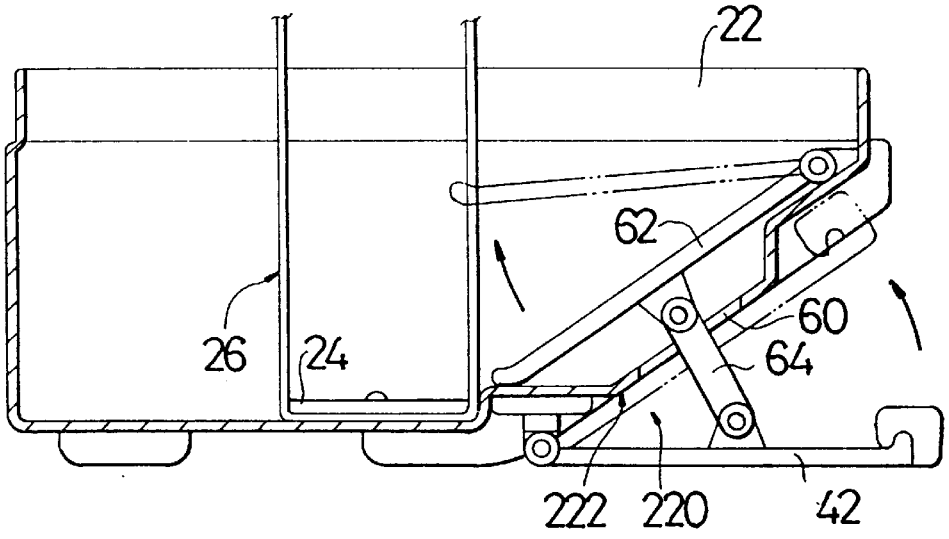
FIG. 2 is a side view in an enlarged scale of the lower part of the golf bag shown in FIG. 1, showing the linkage between the bottom plate and the support plate.

Referring to FIGS. from 1 to 3 again, the bottom cuff 22 has a cut 220 defining a sloping wall 222. The aforesaid bottom plate 42 is pivoted to the bottom side of the sloping wall 222. A support plate 62 is mounted inside the bottom cuff 22 for supporting golf clubs in one storage chamber in the body 20 of the bag 12. The support plate 62 has a fixed end pivoted to an upper part of the bottom cuff 22 on the inside adjacent to the top side of the sloping wall 222. Two links 64 are inserted through respective through holes 60 on the sloping wall 222 of the bottom cuff 22, and coupled between the bottom plate 42 and the support plate 62. When the bag 12 is tilted and then pressed down, the legs 40 are forced outwards by the spring wire rod 44 to the extended position to support the bag 12 on the ground in a tilted position, and at the same time the bottom plate 42 is closely attached to the sloping wall 222 of the bottom cuff 22 and supported on the ground, and therefore the bag 12 is stably supported on the ground by the legs 40 and the bottom plate 42. When the bottom plate 42 is closely attached to the sloping wall 222 of the bottom cuff 22, the support plate 62 is forced upwards from the sloping wall 222 to a horizontal position (see the dotted line shown in FIG. 2) to lift respective storage golf clubs out of the top cuff 28.

Figure 5:
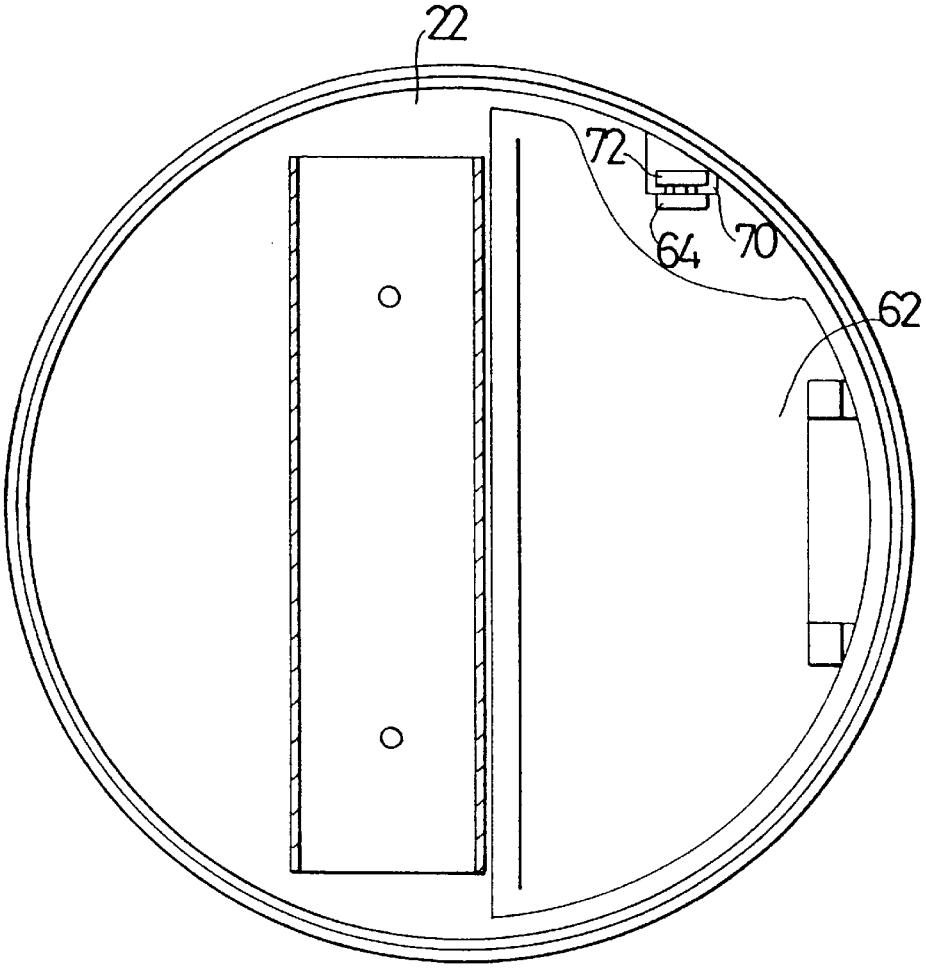
FIG. 5 is a top plain view of the golf bag shown in FIG. 4.
Figure 4:
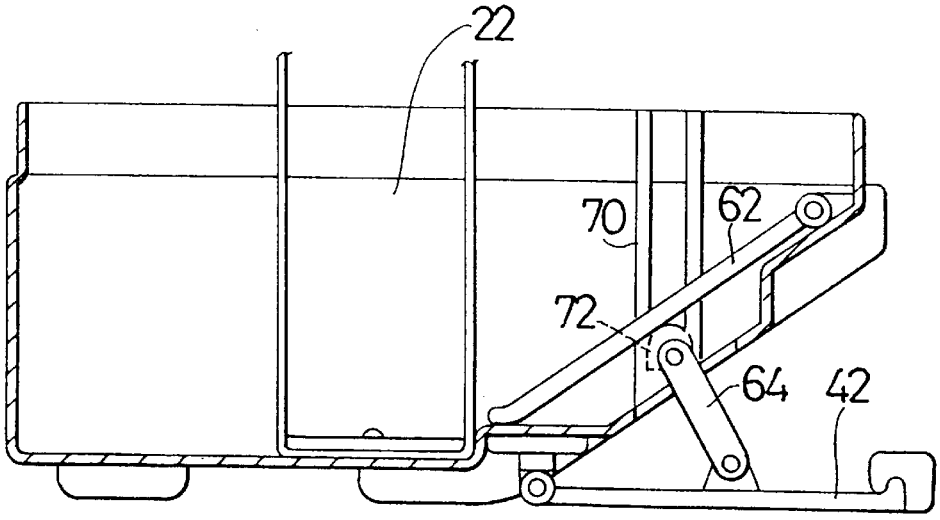
FIG. 4 is a side view of the lower part of the golf bag according to an alternate form of the present invention.

FIGS. 4 and 5 show an alternate form of the present invention. According to this alternate form, two vertical sliding tracks 70 are provided inside the bottom cuff 22, and two sliding blocks 72 are respectively moved in the vertical sliding tracks 70. The support plate 62 is supported on the sliding blocks 72. The links 64 are respectively coupled between the sliding blocks 72 and the bottom plate 42. Because the sliding blocks 72 are reciprocated to turn the support plate 62 about an axis, the top edge of each sliding block 72 is preferably made smoothly curved.

It is to be understood that the drawings are designed for purposes of illustration only, and are not intended as a definition of the limits and scope of the invention disclosed, and various modifications and changes could be made thereunto without departing from the spirit and scope of the invention disclosed. For example, two steel cables or flexible cord members may be used and connected between the support plate 62 and the legs 40 (or the spring wire rod 44) instead of the links 64, for permitting the support plate 62 to be moved with the bottom plate 42.

What the invention claimed is:

1. A golf bag comprising a bag body for holding golf clubs, said bag body having a top cuff and a bottom cuff at top and bottom sides respectively thereof, and a foldaway stand pivoted to the top cuff of said bag body, said foldaway stand comprising two pivoted legs for supporting said bag body on the ground in a tilted position, a bottom plate, said bottom plate having a fixed end pivoted to said bottom cuff of said bag body at a bottom side and an end, and a substantially V-shaped spring wire rod coupled between the end of said bottom plate and top ends of said legs, wherein a support plate is mounted inside said bottom cuff for supporting golf clubs in one of a plurality of storage chambers in said bag body, said support plate having a fixed end pivoted to an inside wall of said bottom cuff remote from the fixed end of said bottom plate and a free end; at least one linking element coupled between said bottom plate and said support plate, for permitting said support plate to be pivotally turned upwards and downwards selectively with said bottom plate.

2. The golf bag of claim 1, wherein said at least one linking element comprises at least one rod-like link inserted through a respective through hole on said bottom cuff, each of said at least one rod-like link having a fixed end connected to said bottom plate and a free end stopped at the free end of said support plate.

3. The golf bag of claim 2, wherein the free end of each of said at least one rod-like link is mounted with a sliding block moved in a respective vertical sliding track inside said bottom cuff and stopped at the free end of said support plate at a bottom side.

4. The golf bag of claim 1, wherein said at least one linking element comprises at least one rod-like link inserted through a respective through hole on said bottom cuff, each of said at least one rod-like link having a fixed end pivoted to said support plate and a free end stopped at the end of said bottom plate.

5. The golf bag of claim 4, wherein a flexible, substantially U-shaped partition member is suspended from said top cuff inside said bag body, said U-shaped partition member having two opposite ends respectively connected to said top cuff and a middle portion connected to said bottom cuff by a mounting plate, said partition member dividing the holding space of said bag body into three storage chambers for holding golf clubs, one of said storage chambers receiving said support plate.

6. The golf bag of claim 1, wherein said at least one linking element comprises at least one rod-like link inserted through a respective through hole on said bottom cuff, each of said at least one rod-like link having a first end pivoted to said support plate and a second end pivoted to said bottom plate.

7. The golf bag of claim 1, wherein said bottom cuff has a sloping wall, said sloping wall having a top side to which the fixed end of said support plate is pivoted inside said bottom cuff, a bottom side to which the fixed end of said bottom plate is pivoted outside said bottom cuff, and at least one through hole through which said at least one linking element passes respectively.

8. A golf bag comprising a bag body for holding golf clubs, said bag body having a top cuff and a bottom cuff at top and bottom sides respectively thereof, and a foldaway stand pivoted to the top cuff of said bag body, said foldaway stand comprising two pivoted legs for supporting said bag body on the ground in a tilted position, a bottom plate, said bottom plate having a fixed end pivoted to said bottom cuff of said bag body at a bottom side and an end, and a substantially V-shaped spring wire rod coupled between the end of said bottom plate and top ends of said legs, wherein a support plate is mounted inside said bottom cuff for supporting golf clubs in one of a plurality of storage chambers in said bag body, said support plate having a fixed end pivoted to an inside wall of said bottom cuff remote from the fixed end of said bottom plate and a free end; at least one flexible linking element coupled between said support plate and said foldaway stand, for permitting said support plate to be turned upwards when said pivoted legs are extended out to support said bag body on the ground.

* * * * *